US012790083B2

(12) United States Patent
Brown

(10) Patent No.: US 12,790,083 B2
(45) Date of Patent: Nov. 10, 2026

(54) FOOD CONTAINER WITH LOCKABLE INTEGRATED LID

(71) Applicant: Papa John's International, Inc., Louisville, KY (US)

(72) Inventor: Joel Brown, White, GA (US)

(73) Assignee: Papa John's International, Inc., Louisville, KY (US)

( * ) Notice: Subject to any disclaimer, the term of this patent is extended or adjusted under 35 U.S.C. 154(b) by 0 days.

(21) Appl. No.: 18/667,630

(22) Filed: May 17, 2024

(65) Prior Publication Data

US 2024/0383652 A1 Nov. 21, 2024

Related U.S. Application Data

(60) Provisional application No. 63/503,358, filed on May 19, 2023.

(51) Int. Cl.

| | |
|---|---|
| ***B65D 43/16*** | (2006.01) |
| ***B65D 21/02*** | (2006.01) |
| ***B65D 25/04*** | (2006.01) |
| ***B65D 51/16*** | (2006.01) |

(52) U.S. Cl.

CPC ..... *B65D 43/162* (2013.01); *B65D 21/0233* (2013.01); *B65D 25/04* (2013.01); *B65D 51/1611* (2013.01); *B65D 2543/00101* (2013.01); *B65D 2543/00296* (2013.01); *B65D 2543/00518* (2013.01); *B65D 2543/00546* (2013.01); *B65D 2543/00648* (2013.01); *B65D 2543/00685* (2013.01); *B65D 2543/00759* (2013.01); *B65D 2543/00796* (2013.01)

(58) Field of Classification Search

CPC ..... B65D 43/162; B65D 21/0233; B65D 25/04; B65D 51/1611; B65D 2543/0049; B65D 2543/00685

USPC ..... 206/518; 220/780

See application file for complete search history.

(56) References Cited

U.S. PATENT DOCUMENTS

| | | | | |
|---|---|---|---|---|
| 3,685,717 | A * | 8/1972 | Seiferth | B65D 75/32 206/499 |
| 4,081,646 | A * | 3/1978 | Goltsos | A47G 23/06 426/243 |
| 5,887,749 | A * | 3/1999 | Schommer | A01K 5/0114 220/575 |
| 7,114,630 | B2 * | 10/2006 | Dege | B65D 43/0212 220/523 |
| 8,061,547 | B2 * | 11/2011 | Camp, Jr. | A45C 11/20 220/592.25 |
| D660,659 | S * | 5/2012 | Cohen | D7/629 |
| 8,317,024 | B1 * | 11/2012 | Persi | B65D 21/023 206/508 |
| 8,985,382 | B2 * | 3/2015 | Vernon | B65D 81/3216 206/508 |
| D905,572 | S * | 12/2020 | Flanagan | D9/425 |
| 2004/0232026 | A1 * | 11/2004 | Goeking | B65D 51/1672 206/459.1 |
| 2005/0092763 | A1 * | 5/2005 | Haggerty | B65D 83/0864 220/812 |

(Continued)

*Primary Examiner* — Steven A. Reynolds

(74) *Attorney, Agent, or Firm* — DLA PIPER LLP US

(57) ABSTRACT

A container with a first portion configured to hold a food item, a second portion configured to hold a condiment or sauce for the food item, and an integrated lockable lid for maintaining the food item and condiment/sauce within the container.

20 Claims, 9 Drawing Sheets

(56) References Cited

U.S. PATENT DOCUMENTS

| | | | | |
|---|---|---|---|---|
| 2006/0201950 | A1* | 9/2006 | Liu | B65D 1/36 220/521 |
| 2009/0179039 | A1* | 7/2009 | Cimmerer | B65D 21/022 220/781 |
| 2013/0068774 | A1* | 3/2013 | Buck | A47G 19/30 220/521 |
| 2018/0370711 | A1* | 12/2018 | Grove | B65D 81/3205 |
| 2019/0135478 | A1* | 5/2019 | Appendini | B65D 43/0212 |
| 2020/0223588 | A1* | 7/2020 | Blackmore | B65D 43/0208 |

* cited by examiner

SECTION A-A

FOOD CONTAINER WITH LOCKABLE INTEGRATED LID

CROSS-REFERENCE TO RELATED APPLICATION

This application claims the benefit of U.S. provisional Patent Application No. 63/503,358, filed on May 19, 2023, which is incorporated herein by reference in its entirety.

FIELD

The disclosed embodiments include containers with lockable lids for containing food items and more particularly to containers with a first portion configured to hold a food item (e.g., chicken wings, mozzarella sticks, jalapeno poppers, breadsticks, French fries, etc.), a second portion configured to hold a condiment or sauce for the food item, and an integrated lockable lid for maintaining the food item and condiment/sauce within the container.

BACKGROUND

Restaurants that offer take-out and delivery services often use special packaging for the particular food item. For example, pizza might be delivered or taken out in a box having the approximate size of the pizza. Chicken wings, mozzarella sticks, jalapeno poppers, breadsticks, French fries, other similar loose food items, to name a few, may be delivered or taken out in a much smaller box. The smaller items are also wrapped in or held in foil or wax paper for various purposes such as e.g., keeping the items warm and or separated from the box's cardboard or Styrofoam walls, particularly food items covered in sauce or seasoning.

Traditionally, the boxes for the smaller and or loose food items are made of cardboard or Styrofoam. Because the boxes all look alike and are not see through (e.g., because they usually contain some kind of logo, message and or graphic associated with the restaurant), visually determining and or confirming the contents within the box without opening the box is difficult and often requires the application of a sticker and or writing on the box (e.g., checked box) to help identify the contents. Because the food item cannot be seen once in the box, this is prone to human errors, which can cause mis-deliveries and or the customer taking out the wrong order. Moreover, opening up the box just to visually observe its contents allows heat to escape, among other potential problems, which is undesirable.

The typical boxes are also maintained closed by a tab or other means, which are easily opened when jostled in a vehicle or dropped by restaurant personnel or the purchaser. In addition, these boxes are not suitable for reheating the food item (e.g., via a microwave), particularly when the food item is wrapped in foil or wax paper. Oftentimes the box does not have a suitable mechanism for maintaining a sauce or condiment that typically is sold with the food item contained therein (e.g., sauce or dressing for wings, dipping sauce for mozzarella sticks, ketchup for fries, etc.), which is another reason why the food item is wrapped in paper and or foil. All of these problems are undesirable.

Accordingly, there is a need and desire for a container for food items such as loose food items (e.g., chicken wings, mozzarella sticks, jalapeno poppers, breadsticks, French fries, etc.) that overcomes the above and other shortcomings.

SUMMARY

One or more embodiments described herein are used to provide containers with lockable lids for food items such as loose food items (e.g., chicken wings, mozzarella sticks, jalapeno poppers, breadsticks, French fries, etc.). In one or more embodiments, the container has a body with a first portion configured to hold a food item e.g., loose food item, a second portion configured to hold a condiment or sauce, typically in its own cup or other closed container, for the food item, and a lockable lid that is integrated as part of the body and configured for maintaining the food item and condiment/sauce cup/package within the container. The lid can include a protrusion configured to interact with the first portion such that the first portion can be sealed.

For example, a container disclosed herein may comprise a male/female 360-degree nest-locking mechanism with click indicators to indicate when the lid is locked onto the container body's first portion. In one or more embodiments, the second portion of the container body is configured with a first region for holding the condiment or sauce, typically within its own sealed cup or small container, that is adjacent one or more other regions (referred to herein as finger indentations) providing a user of the container with an easy mechanism for removing the condiment or sauce cup/package from the second portion of the container body. In one or more embodiments, the container lid is a clear/see-through lid, allowing the contents to be seen and visually confirmed without the need for stickers or other external indicia, avoiding order/pickup errors that can arise with the conventional box/Styrofoam container of the prior art. In one or more embodiments, the container is leak-resistant, includes an audible snap closure that will 1) indicate to the restaurant personnel or customer that the lid is locked onto the body; and 2) keep the lid on the container body (i.e., a closed position) during handling and transport, preventing messy spills.

Many of the illustrated embodiments are shown and described for use with food items such as loose food items (e.g., chicken wings, mozzarella sticks, jalapeno poppers, breadsticks, French fries, etc.). As used herein a loose food item is an edible item comprising one or more individual items whether loose (chicken wings, poppers) or loosely connected (separable bread sticks). However, it should be appreciated that the principles disclosed herein are not to be limited to the specific end-product(s) contained in the container. For example, the container could be used to house a salad or pasta food item. Likewise, the disclosed principles should not be limited to housing, in the second portion of the container body, the illustrated chicken wing sauce cup because the disclosed embodiments apply to any condiment or accompanying sauce, etc., that fits within the second portion of the body.

In one or more embodiments, the container can comprise a body having a first portion that includes a first cavity and a second portion that includes a second cavity. The container can also comprise a lid including a first portion for covering the first portion of the body and a second portion for covering the second portion of the body when the lid is placed in a closed position. The first portion of the body can include a protrusion accepting region and the first portion of the lid can include a protrusion portion. The protrusion accepting region of the body can be configured to mate with the protrusion portion of the lid to form a locking mechanism.

In some embodiments, the locking mechanism can include a male/female 360-degree nest-locking mechanism including a plurality of click indicators disposed on at least one surface of at least one of the protrusion accepting region and the protrusion portion.

In some embodiments, the locking mechanism can seal the first portion of the body.

In some embodiments, the container can further comprise a hinge coupled between the body and the lid, such that the body and the lid form an integrated container.

In some embodiments, the second portion of the body can comprise a plurality of finger indentations adjacent the second cavity, the plurality of finger indentations being configured to optimize retrieval of the condiment/sauce from the second cavity.

In some embodiments, the container can further comprise a plurality of stacking lugs disposed within the body such that a plurality of open containers can be stacked nesting within each other.

In some embodiments, the container can further comprise a plurality of vents disposed in the first portion of the lid.

BRIEF DESCRIPTION OF THE FIGURES

Various objectives, features, and advantages of the disclosed subject matter can be more fully appreciated with reference to the following detailed description of the disclosed subject matter when considered in connection with the following drawings, in which like reference numerals identify like elements.

Figure 1:
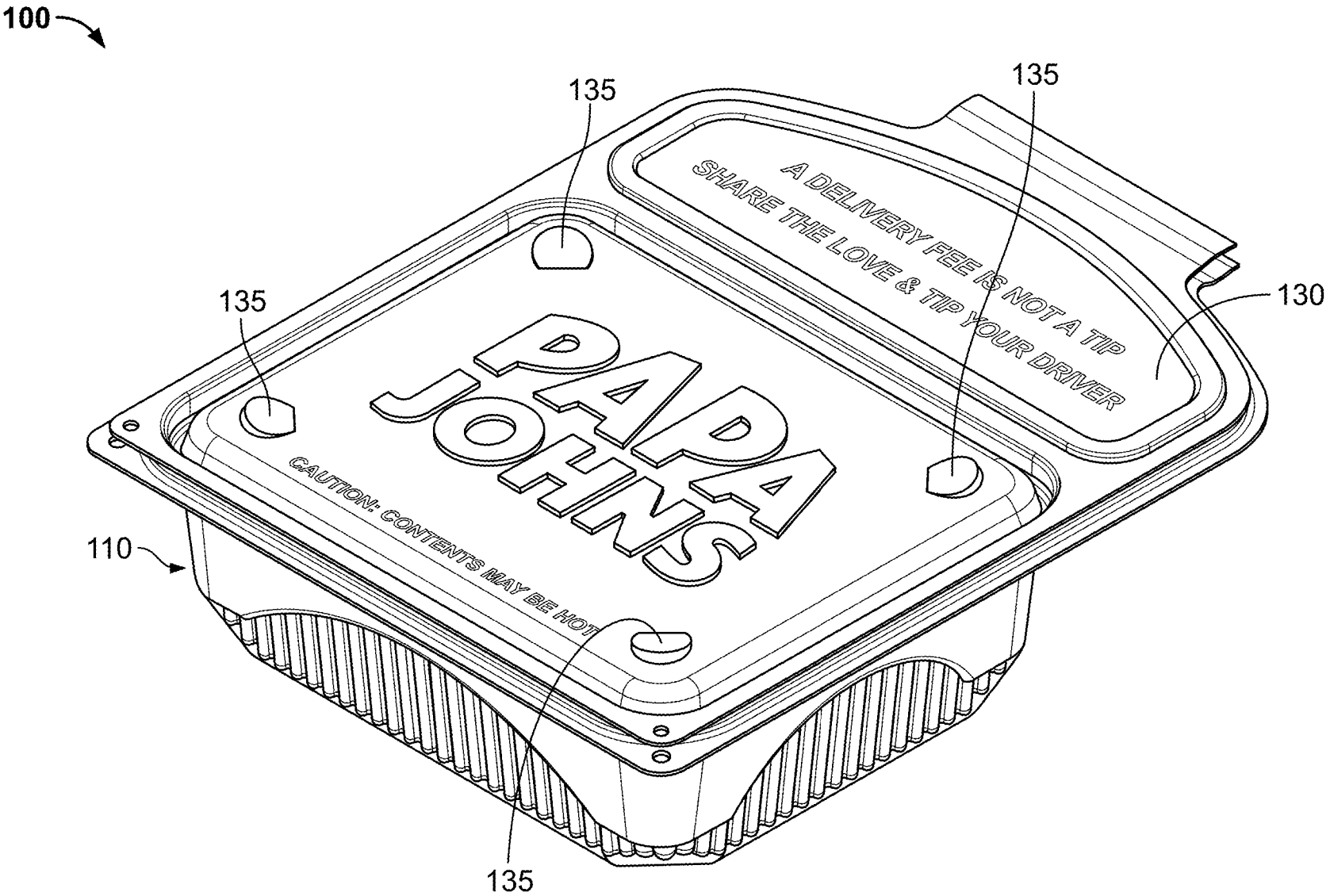
FIG. 1 is a perspective view of an illustrative container with a lockable lid constructed in accordance with the disclosed principles.
Figure 2:
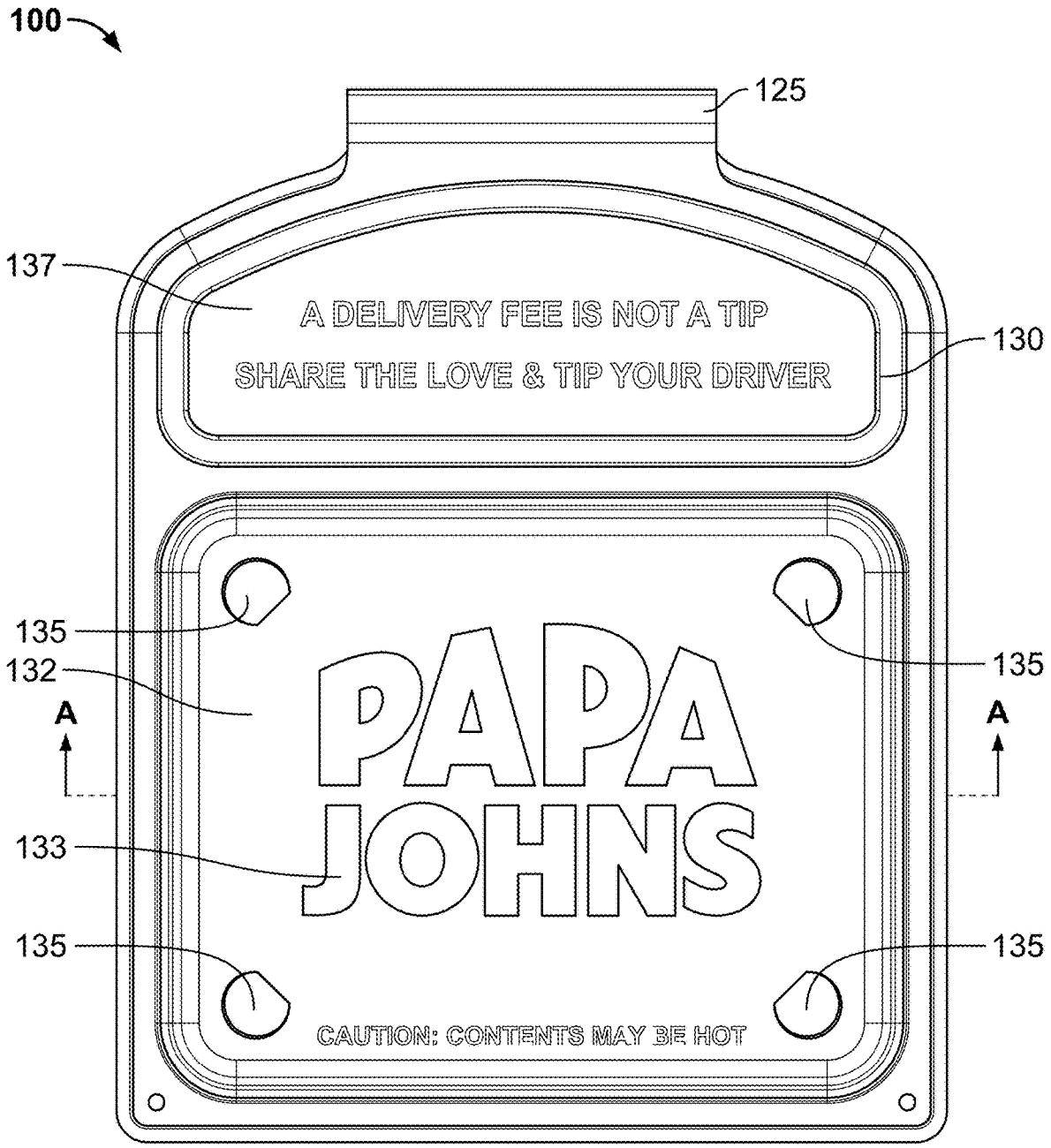
FIG. 2 is a top view of the lid of the illustrative container constructed in accordance with the disclosed principles.

The drawings are not necessarily to scale, or inclusive of all elements of a system, emphasis instead generally being placed upon illustrating the concepts, structures, and techniques sought to be protected herein.

DETAILED DESCRIPTION OF EMBODIMENT OF THE INVENTION

The following detailed description is merely exemplary in nature and is not intended to limit the claimed invention or the applications of its use.

FIGS. 1-6 illustrate a first example of a container 100 with a lockable lid in accordance with a first embodiment disclosed herein. In the illustrated embodiment, the container 100 includes a lid 130 that is clear and a body 110 that is opaque (e.g., black). In some embodiments, the lid 130 can be clear or opaque. In some embodiments, the body 110 can be clear or opaque. In one or more embodiments, the body 110 and lid 130 can be different "colors" and/or transparencies. For example, both components can be clear or opaque, or a combination thereof. As another example, black portions can be white or other desirable color. The lid 130 can include a plurality of vents 135 positioned throughout the lid 310 to allow steam or hot air to exit the container 100 when it is in a closed position (i.e., when the lid 130 is fastened to the body 110). In some embodiments, the vents 135 can be at each of four corners of the lid 130.

In some embodiments, the lid 130 and body 110 are connected by a hinge 125 such that the lid 130 and the body 110 are an integrated device. In some embodiments, the lid 130 can include a first portion 132 and a second portion 137. In some embodiments, the plurality of vents 135 can be positioned within the first portion 132 of the lid 130.

In some embodiments, the first portion 132 and the second portion 137 can include embossed characters 133. The embossed characters 133 can include embossed text, symbols, logos, and or a background for the lid. This, for example, can be used to identify the proprietor (e.g., Papa Johns®), provide a warning (e.g., "Caution Contents May Be Hot"), and or another message (e.g., "A Delivery Fee Is Not a Tip . . . "). It should be appreciated that the disclosed embodiments should not be limited to the specific embossing illustrated in the figure.

Figure 3:
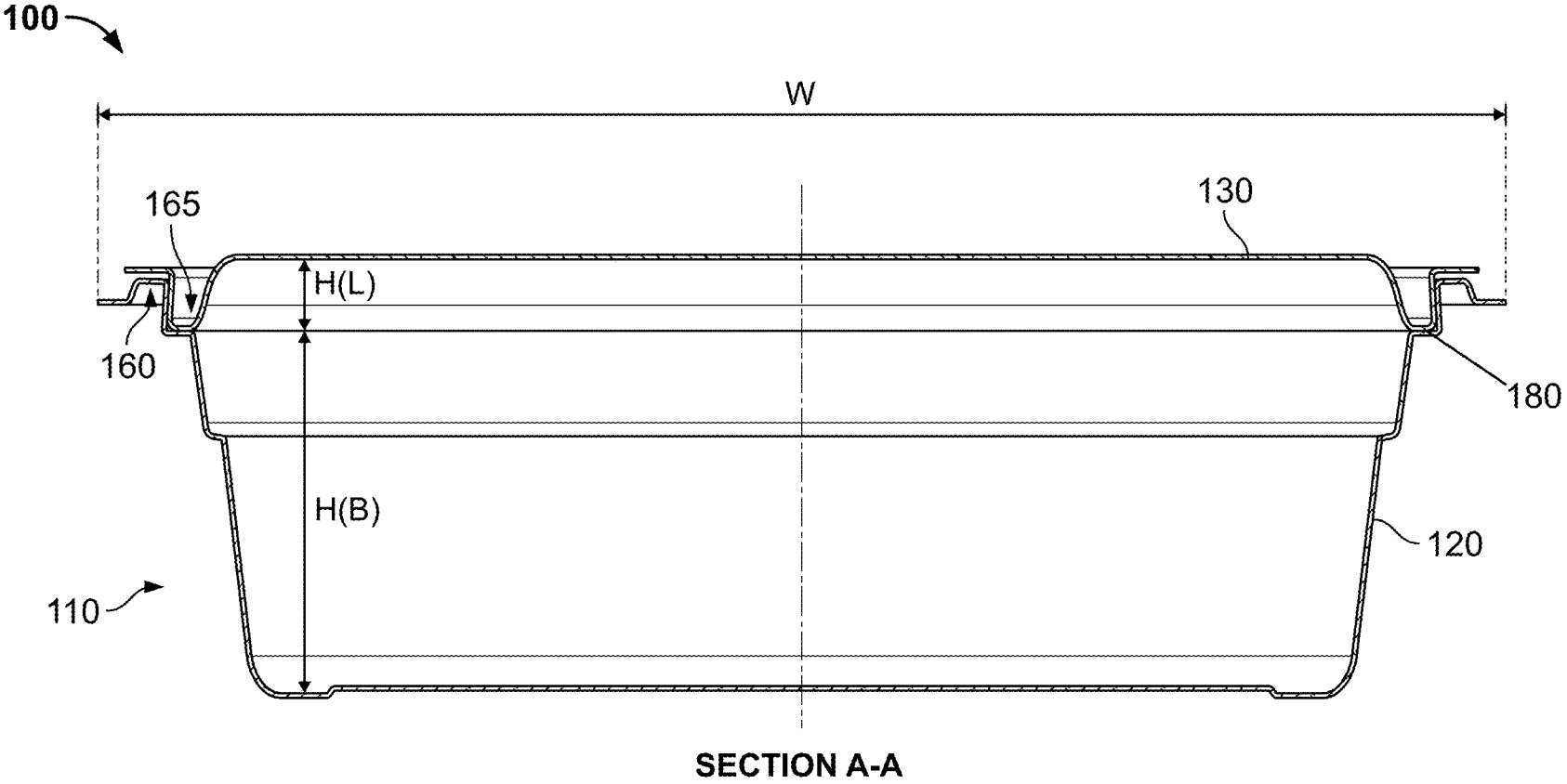
FIG. 3 is a cross-sectional view of the illustrative container constructed in accordance with the disclosed principles.

FIG. 3 shows an illustrative cross section of the container 100 taken along line A-A of FIG. 2*s*. Example dimensions and fill volumes for the illustrated container are provided herein. In some examples, a width (W) of the container 100 can be 6.78 inches. In some examples, a height (H (B)) of the body 110 can be 1.75 inches. In some examples, a height (H (L)) of the lid 130 can be 0.36 inches. In some examples, a fill volume of the first portion 132 of the lid 130 can be 4.6 fluid ounces and a fill volume of the first portion 120 of the body 110 can be 23.5 fluid ounces, for a total fill volume of the first portion 120 of the body 110 of 28 fluid ounces. It should be appreciated that the disclosed embodiments should not be limited to the dimensions or volumes disclosed.

Figure 4:
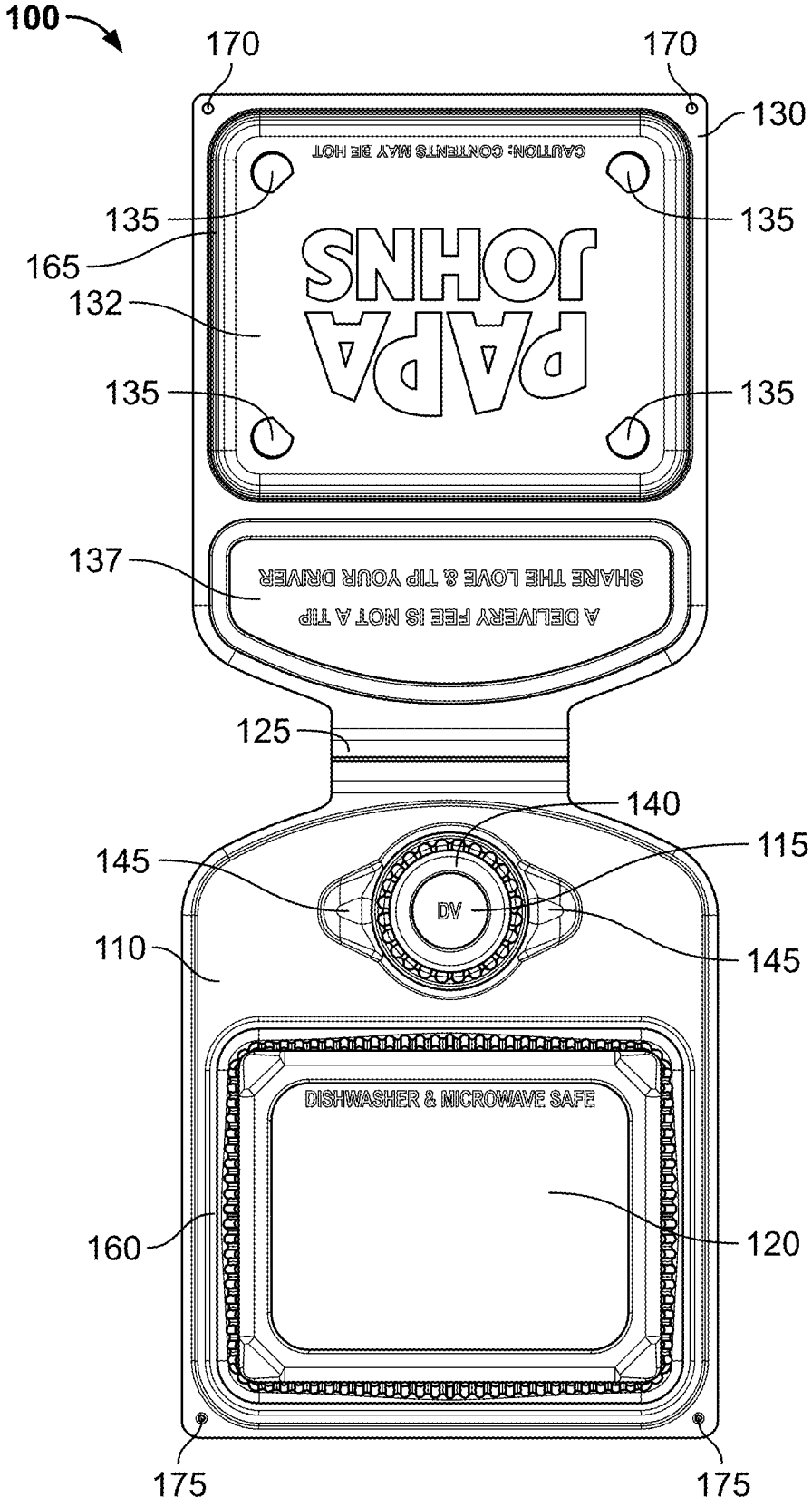
FIG. 4 is an open view of the illustrative container constructed in accordance with the disclosed principles.

FIG. 4 shows an open view of the container 100 of FIG. 1. In some embodiments, the container 100 has an hourglass shape when in an open position due to the hinge 125 having a width that is smaller than the widths of the body 110 and lid 130. In some embodiments, the body 110 comprises a first portion 120 (e.g., a cavity formed with four sidewalls and a bottom) configured to hold a food item such as a loose food item (e.g., chicken wings, mozzarella sticks, jalapeno poppers, French fries, etc.) and a second portion 115 (e.g., a second cavity) configured to hold a condiment or sauce, typically in a cup or small container, for the food item. The second portion 115 can include a first region 140 (e.g., formed with a continuous circular sidewall and a bottom) for the cup that is adjacent one or more other regions 145 (referred to herein as finger indentations), providing a user of the container with an easy mechanism for removing the condiment or sauce cup/container/package from the second portion 115 of the container body 110. In some embodiments, the vents 135 can be on the first portion 132 of the lid 130, which is configured to cover the first portion 120 of the body 110 when the container 100 is in the closed position. In some embodiments, the second portion 137 of the lid can be configured to cover the second portion 115 of the body 110 when the container is in the closed position.

In one or more embodiments, the lid 130 has a protrusion portion 165 such as part of a male/female 360-degree nest-locking mechanism (e.g., forming a rectangular shape) for locking onto a corresponding groove and protrusion accepting region 160 of the container body 110 (with a corresponding shape). In an example embodiment, the locking mechanism makes an audible sound (e.g., click) when the lid 130 is locked onto the body 110. The audible sound can be generated by a plurality of click indicators 180 disposed on at least one surface of at least one of the protrusion portion 165 and the protrusion accepting region 160. In one or more embodiments, the lid 130 is integrated as part of the body 110 and when locked onto the body 110 maintains the food item and condiment/sauce within the container 100. Contents within the container 100 can be seen through the clear lid 130. In embodiments when the body 110 is clear, the contents can be seen through the body 110. In some embodiments, the protrusion portion 165 surrounds the first portion 132 of the lid 130 and the protrusion accepting region 160 is surrounding the first portion 120 of the body 110 such that the first portion 120 of the body 110 is sealed when the container is in the closed position. The sealing of the first portion 120 of the body 110 can provide for separation of the two cavities 115, 120 such that contents of the first portion 120 is prevented from entering the second portion 115, and vice versa, while the container 100 is in the closed position. In some embodiments, the hinge 125 provides sufficient support for the lid 130 to prevent the contents of the second portion 115 of the body 110 from escaping the container 100.

The locking mechanism can include various configurations. In some embodiments, the protrusion region 165 of the lid 130 can fit within the bounds of the protrusion accepting region 160 of the body 110 to seal the first portion 120. In some embodiments, the protrusion region 165 of the lid 130 can surround the protrusion accepting region 160 of the body 110. In some embodiments, the protrusion region 165 of the lid 130 can fit between two portions of the protrusion accepting region 160 of the body 110 such that the protrusion region 165 is sandwiched between portions of the protrusion accepting region 165. The container can also include tabs 170, 175 configured to unlock the locking mechanism. The tabs can be used to unlock the locking mechanism by applying opposing forces to at least two of the tabs 170, 175.

Figure 5:
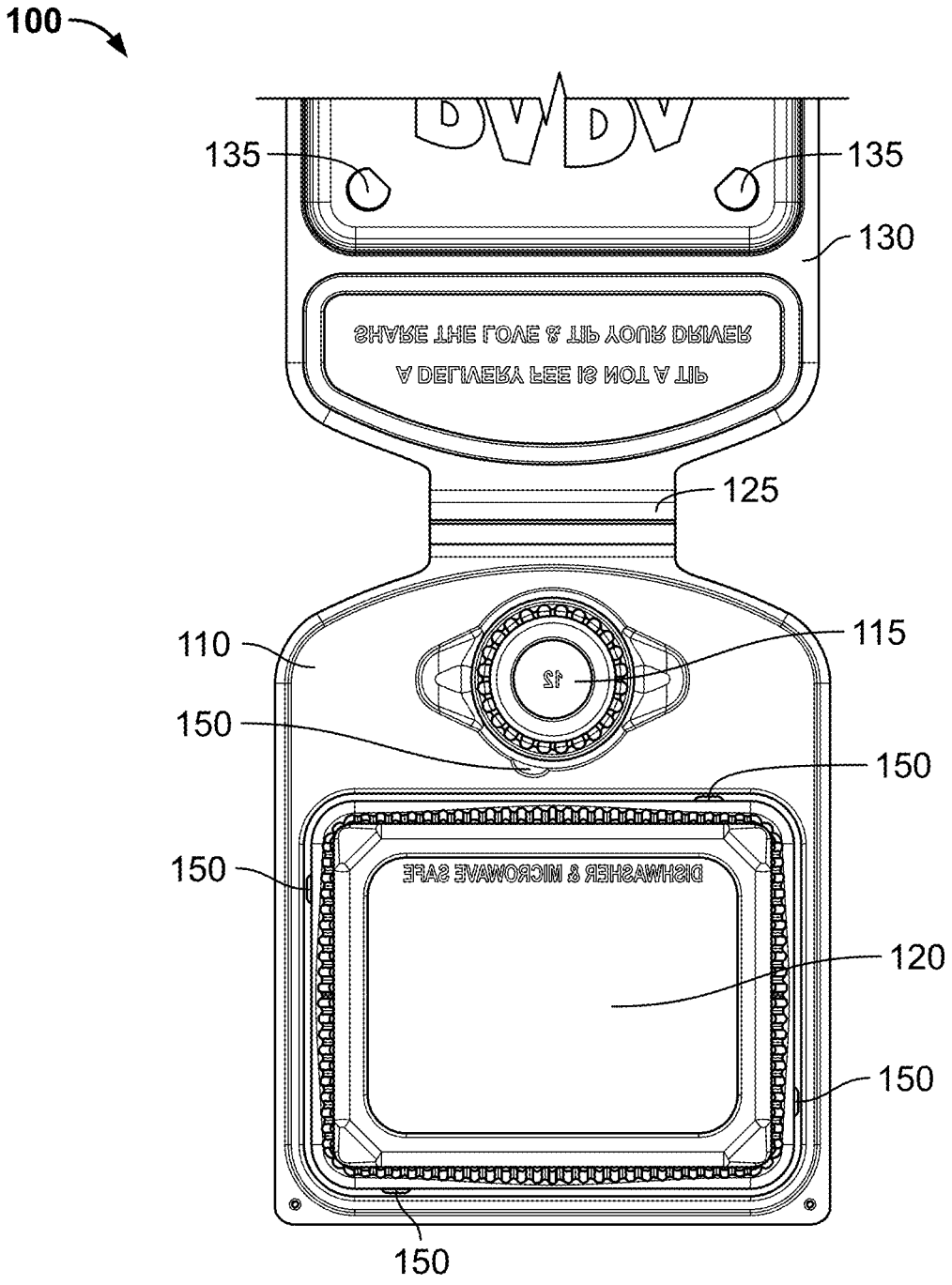
FIG. 5 illustrates stacking lugs integrated into a body of the illustrative container constructed in accordance with the disclosed principles.

FIG. 5 shows stacking lugs 150 integrated into the body 110 of the container 100 in accordance with the disclosed principles. In some embodiments, the stacking lugs 150 can be placed in alternating places of the body 110 to aid with the stacking of the container 100, which in turn optimizes both the cubing of the container 100 and the number of containers 100 that can fit on a delivery truck. The purpose for using stacking lugs can be to allow the containers 100 to de-nest one at a time.

Figure 6:
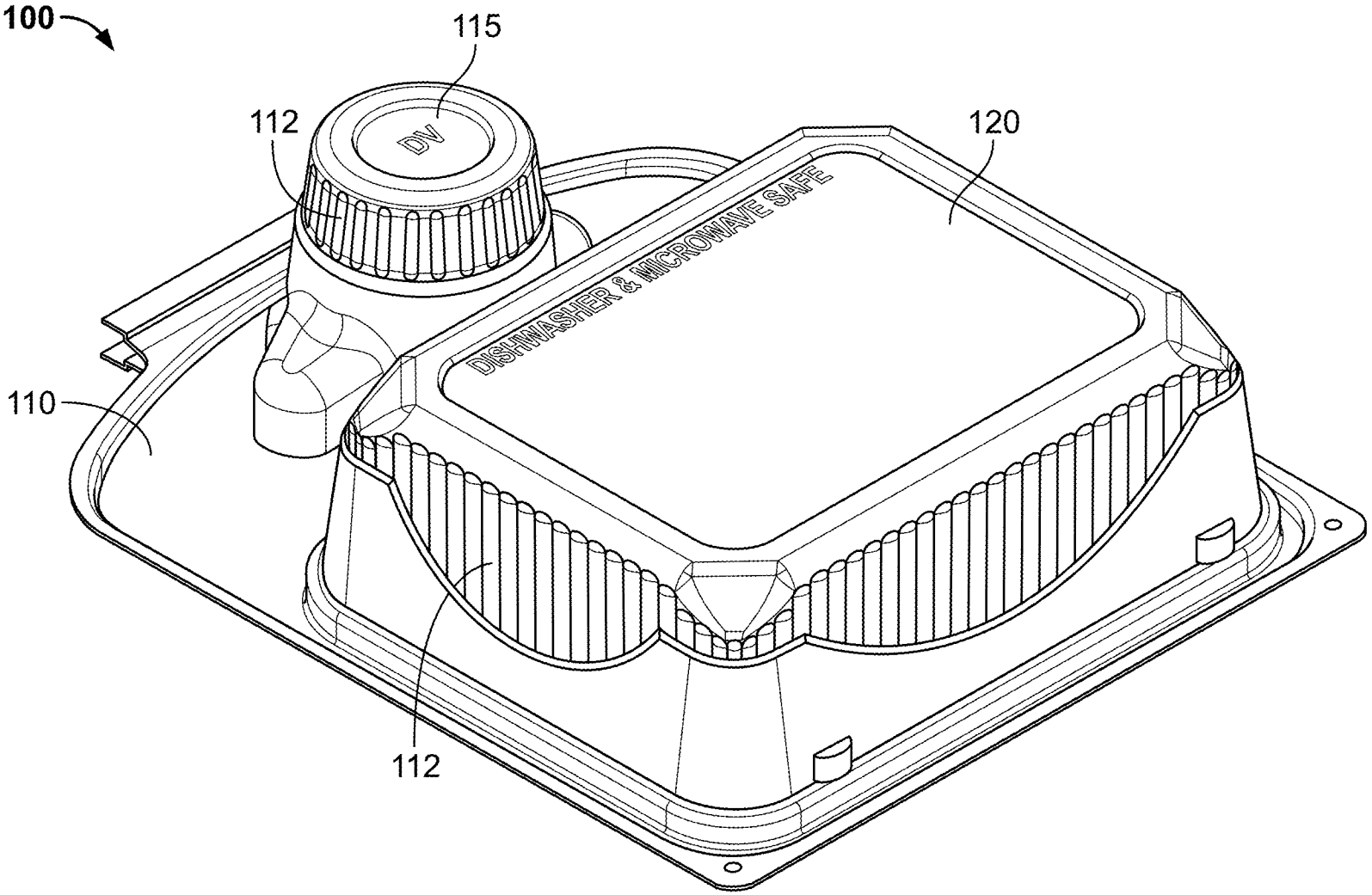
FIG. 6 is a bottom perspective view of a body of the illustrative container constructed in accordance with the disclosed principles.

FIG. 6 shows a bottom perspective view of the body 110 in accordance with example embodiments. The body 110 can be formed of a molded plastic such that the imprint on the inside of the container 100 can correspond to the outside of the container 100. As such, the first portion 120 of the body 110 and the second portion 115 of the body can be seen on the outside of the container 100. In some embodiments, the body 110 can be formed of a clear plastic such that the contents of the container 100 can be visible from outside of the container 100. In some embodiments, the outside of the first portion 120 and the second portion 115 can include ridged portions 112. The ridged portions 112 can improve the user's ability to hold the container 100 securely.

Figure 7:
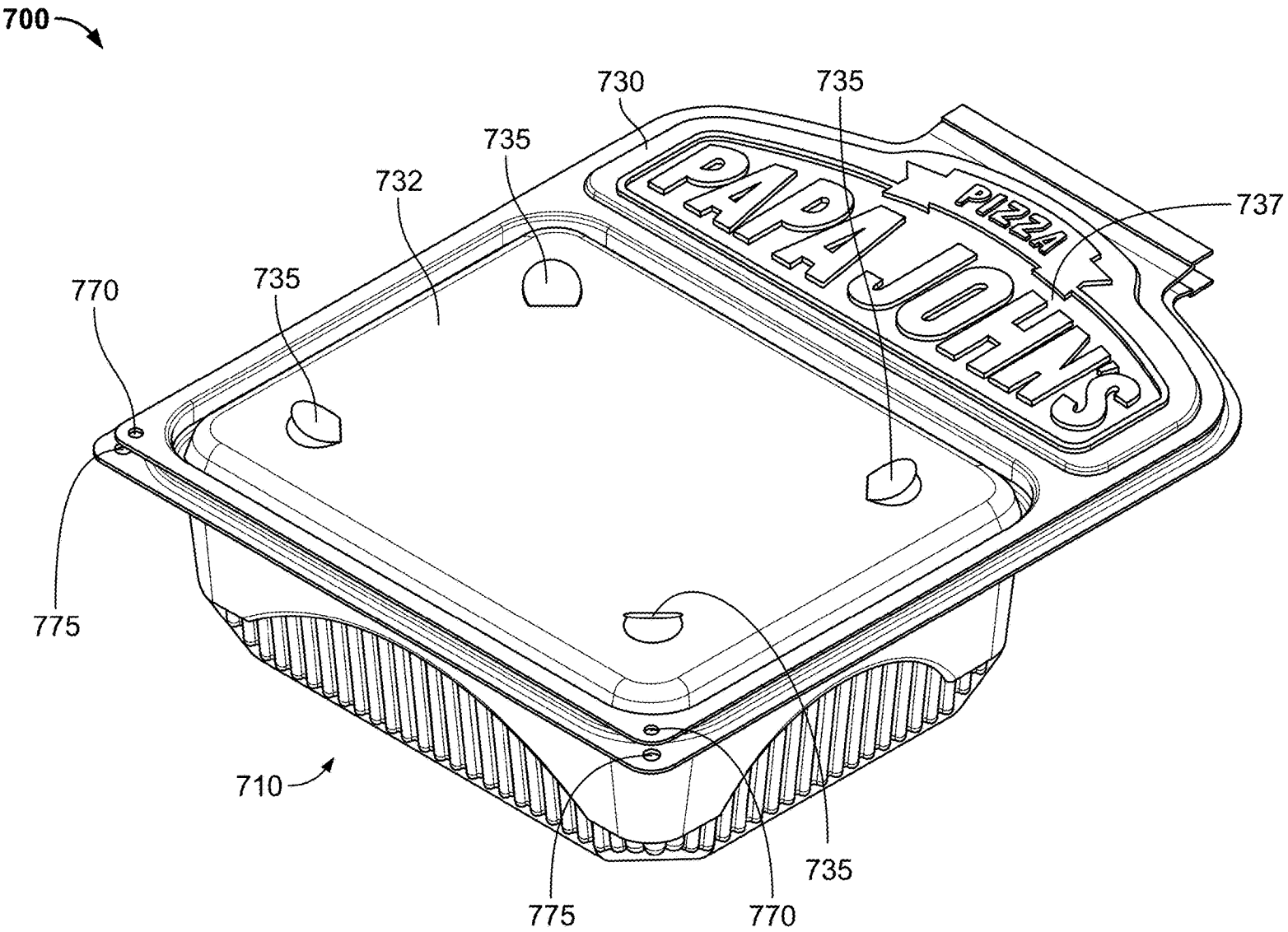
FIG. 7 is a perspective view of another illustrative container with a lockable lid constructed in accordance with the disclosed principles.

FIG. 7 shows an illustrative container 700 with a lockable lid 730 in accordance with a second example embodiment disclosed herein. The container 700 can include a body 710 configured to lock with the lid 730 to prevent spills from the contents of the container 700. In some embodiments, the body 710 can include tabs 775 configured to allow opening of the container 700. In some embodiments, the lid 730 can include opposing tabs 770. The lock between the body 710 and the lid 730 can be opened by exerting force on the tabs 775, 770 in opposing directions. The lid 730 can include a plurality of vents 735 configured to allow steam to vent out of the container 700 when in the closed position. This example container 700 shows different embossing, among other differences (e.g., dimensions and or volumes) from the first example container 100. In some embodiments, the lid 730 can be smooth. In some embodiments, a portion of the lid 730 can include embossed characters (e.g., lettering, symbols, etc.). In some embodiments, a first portion 732 of the lid 730 can be smooth while a second portion 737 of the lid 730 can be textured and/or embossed.

Figure 8:
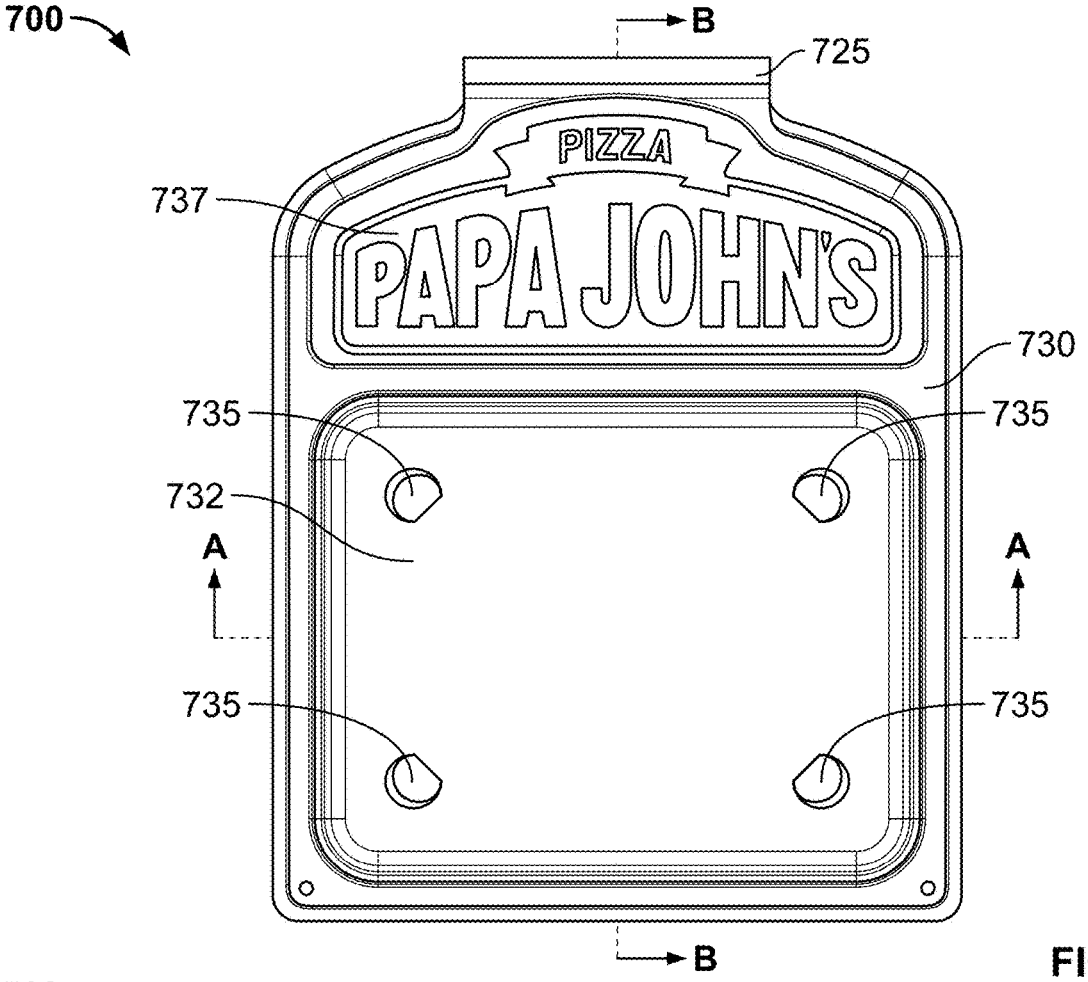
FIG. 8 is a top view of the container illustrated in FIG. 7.

FIG. 8 shows a hinge 725 used to connect the lid 730 to the body 710 in accordance with example embodiments. In the illustrated embodiment, the lid 730, hinge 725 and body 710 are integrated. The hinge 725 can be disposed on a side of the lid 730 parallel to cross-section line A-A and perpendicular to cross-section line B-B. In some embodiments, the lid 730 can be textured. In some embodiments, a portion of the lid 730 can be textured. The first portion 732 of the lid 730 can be textured while the second portion 737 of the lid 730 can be embossed.

Figure 9:
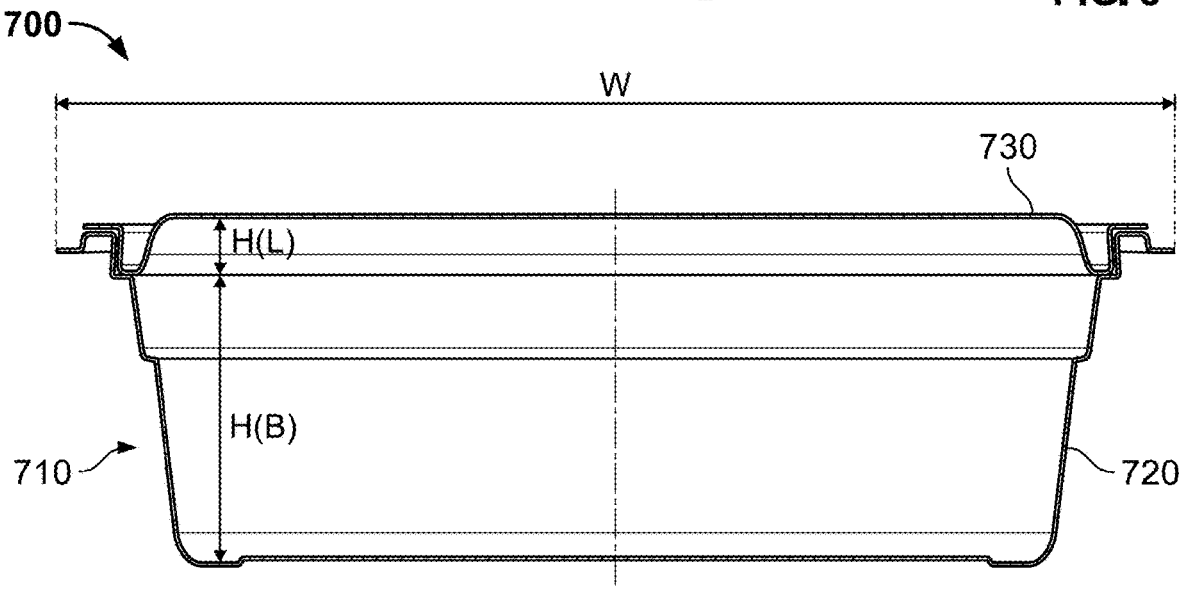
FIG. 9 is a cross sectional view of the second illustrative container illustrated in FIG. 7.

FIG. 9 shows a cross section view of the container 700 taken along line A-A in FIG. 8. Example dimensions and fill volumes for the illustrated container are provided herein. In some examples, a width (W) of the container 700 can be 5.89 inches. In some examples, a height (H (B)) of the body 710 can be 1.75 inches. In some examples, a height (H (L)) of the lid 730 can be 0.35 inches. In some examples, a fill volume of the first portion 132 of the lid 730 can be 8.8 fluid ounces and a fill volume of the first portion 720 of the body 710 can be 23.2 fluid ounces, for a total fill volume of the first portion 720 of the body 710 of 32 fluid ounces. It should be appreciated that the disclosed embodiments should not be limited to the dimensions or volumes disclosed.

Figure 10:
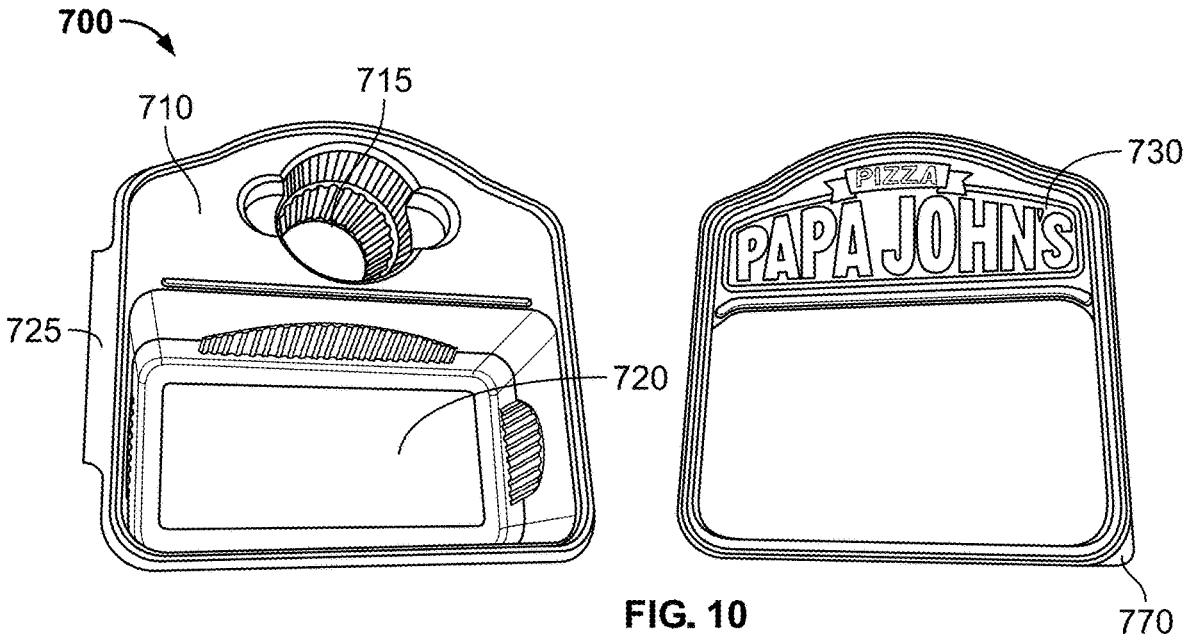
FIG. 10 depicts a container with a side hinge constructed in accordance with the disclosed principles.

FIG. 10 shows a container 700 with a side hinge 725 in accordance with example embodiments. The container 700 can include a hinge 725 perpendicular to cross-section line A-A and parallel to cross-section line B-B, as shown in FIG. 8. In some embodiments, the hinge 725 enables the lid 730 and the body 710 to form a fully integrated container 700. The lid 730 can include a tab 770 configured to unlock the seal between the body 710 and the lid 730.

Figure 11:
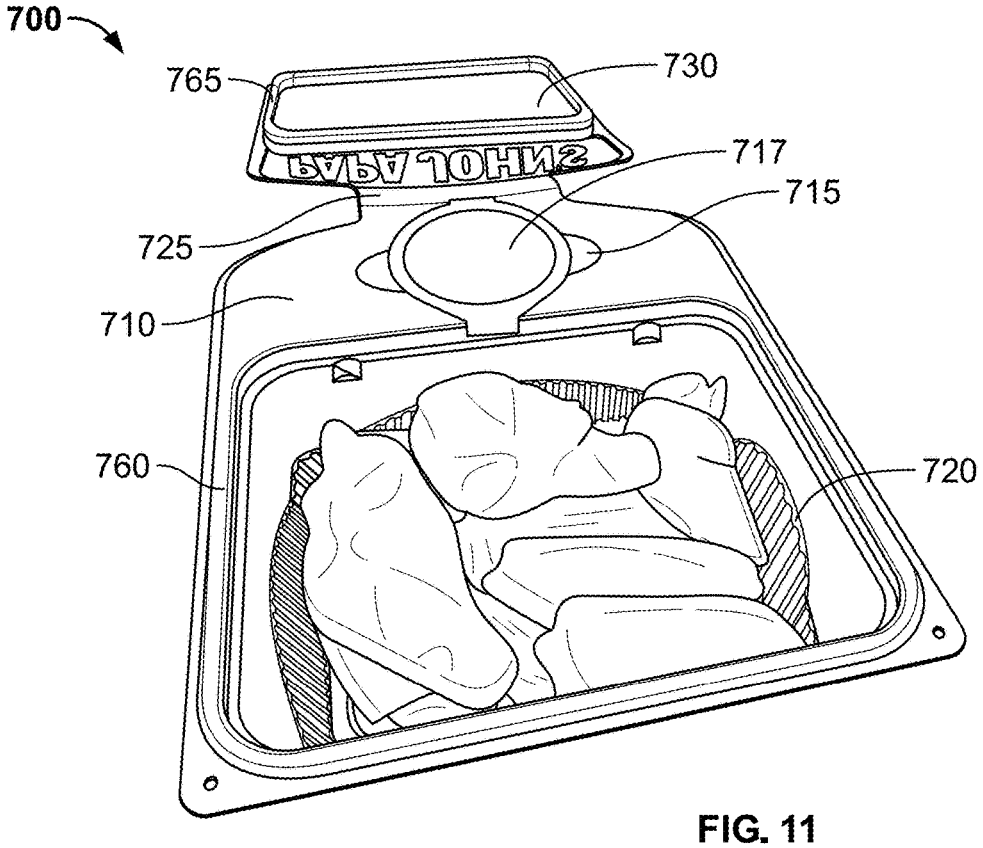
FIG. 11 illustrates an example container disclosed herein in use in accordance with the disclosed principles.

FIG. 11 illustrates an example container 700 in use and containing chicken wings in a first portion 720 of the container body 710 and corresponding sauce cup 717 in a second portion 715 of the container body 710. The lid 730 can be closed over the body 710 using the hinge 725. The lid 730 and the body 710 can be locked together via the corresponding locking mechanisms of the protrusion region 765 of the lid 730 and the protrusion accepting region 760 of the body 710. Once locked, the container 700 can provide for transportation of foodstuff without spillage.

In one or more embodiments, the disclosed food contact packaging is comprised of polypropylene plastic and a colorant (black in the illustrated examples). Embossing is used as a means of identifying at least one of the contents of the container, the brand of the manufacturing company, the brand of the company selling the contents, and/or a trademark/slogan used by the company selling the contents. The overall structure of the container may be referred to as a plastic clamshell. In one or more embodiments, the container's black base and clear lid may be manufactured from black and clear side-by-side extruded sheet stock and comply with FDA and other regulations as articles intended for use in contact with specified food products. The same technique could be used if the body is clear or if the plastic has different colors. In one or more embodiments, the container is microwave and or dishwasher safe.

The disclosed embodiments provide many consumer benefits such as e.g., (1) the food item tasting better in comparison to a boxed food item; (2) a sauce coated food item retains its sauce covering better in comparison to a boxed food item; (3) having the ability to shake the container to recoat the food item with sauce/seasoning; (4) having hotter food items in comparison to a boxed food item; (5) ability to reuse the package for meal-prep and other uses; (6) microwave the food item in the container without having to remove paper or foil wrapping; (7) having a higher quality visual presentation than foil and box; and (8) having a wash-able, re-usable, and recyclable container.

The disclosed embodiments provide many restaurant benefits such as e.g., (1) making work at the cut-station much easier; (2) eliminating the need to fumble with aluminum foil and trying to fit the food item in a box; (3) having a lid that is permanently attached and lockable with no perforations, a larger cavity for the food item; (4) easy to use hinged-lid that can be moved to top of package for ease of use; (5) great solution to implementing dry seasoning application post-oven; (6) better sauce/dry rub coverage compared to foil and box; (7) a single piece of packaging to work with (compared to foil/paper and a cardboard or Styrofoam box); and (8) a prominent chamber for the sauce cup in comparison to a boxed food item; and (9) tighter seals on the container to mitigate leaking.

It should be appreciated that the examples set forth herein are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

The invention claimed is:

1. A container for containing food items, the container comprising:

a body comprising:

a first portion comprising a first cavity; and a second portion comprising a second cavity; and a lid comprising:

a first portion configured to cover the first portion of the body when the container is in a closed position; and a second portion configured to cover the second portion of the body when the container is in the closed position;

wherein the first portion of the body includes a protrusion accepting region surrounding the first cavity, the first portion of the lid includes a protrusion region, and the protrusion accepting region of the body is configured to mate with the protrusion region of the lid to form a locking mechanism surrounding the first cavity when the container is in the closed position, wherein the second portion of the body and the second portion of the lid lack a mechanism for locking the second portion of the body and the second portion of the lid together, and wherein the locking mechanism is configured to lock the container in the closed position without requiring another locking mechanism.

2. The container of claim 1, wherein the locking mechanism seals the first portion of the body.

3. The container of claim 1, wherein the first portion of the body is configured to house a food item such that the food item is prevented from entering the second portion of the body by the locking mechanism.

4. The container of claim 1, wherein the locking mechanism comprises a male/female 360-degree nest-locking mechanism including a plurality of click indicators disposed on at least one surface of at least one of the protrusion accepting region and the protrusion region.

5. The container of claim 1, further comprising:

a hinge coupled between and integrated with the body and the lid.

6. The container of claim 5, wherein the hinge is disposed adjacent the second portion of the body, such that when the container is opened, the body, the lid, and the hinge together form an hourglass shape.

7. The container of claim 1, further comprising:

a plurality of vents disposed in the first portion of the lid.

8. The container of claim 1, further comprising:

a plurality of stacking lugs disposed within the body such that a plurality of open containers can be stacked nesting within each other.

9. The container of claim 1, wherein the lid comprises a clear plastic and the body comprises an opaque plastic.

10. The container of claim 1, wherein the body is formed of a molded plastic.

11. The container of claim 1, wherein the second portion of the body further comprises:

a plurality of finger indentations adjacent the second cavity.

12. The container of claim 1, wherein at least one portion of the lid includes embossed characters.

13. A container for containing food items, the container comprising:

a first body portion configured to hold a food item;

a second body portion coupled to the first body portion by a body portion of the container, the second body portion configured to hold a condiment or a sauce for the food item; and a lockable lid configured to maintain the food item and the condiment or sauce within the container when the container is in a closed position;

wherein the lockable lid includes a first portion of a locking mechanism and the first body portion includes a second portion of the locking mechanism disposed around an edge of the first body portion, the first and second portions of the locking mechanism configured to interact when the container is in a closed position such that the first body portion can be sealed, wherein the second body portion lacks a mechanism for sealing the second body portion with the lockable lid, and wherein the interaction of the first and second portions of the locking mechanism is configured to lock the container in the closed position without requiring another locking mechanism.

14. The container of claim 13, further comprising:

a hinge integrated between the lockable lid and the first body portion.

15. The container of claim 13, wherein the lockable lid comprises a plurality of vents.

16. The container of claim 13, wherein the container is formed of molded plastic.

17. The container of claim 13, wherein the second body portion comprises:

a cavity configured to hold the condiment/sauce for the food item; and a plurality of finger indentations adjacent the cavity.

18. The container of claim 13, further comprising:

a plurality of stacking lugs disposed throughout the first body portion and the second body portion.

19. The container of claim 13, further comprising:

a plurality of click indicators disposed on at least one of the first portion of the locking mechanism or the second portion of the locking mechanism.

20. The container of claim 13, wherein the lockable lid comprises a clear plastic and wherein the first body portion and the second body portion comprise an opaque plastic.

* * * * *